United States Patent [19]

Janitzky

[11] Patent Number: 4,507,899

[45] Date of Patent: Apr. 2, 1985

[54] UNDERGROUND SHELTER

[76] Inventor: Manfred Janitzky, Konigstrasse 10, 4053 Juchen 5, Fed. Rep. of Germany

[21] Appl. No.: 422,559

[22] Filed: Sep. 24, 1982

[30] Foreign Application Priority Data

Nov. 6, 1981 [DE] Fed. Rep. of Germany ..... 3144141

[51] Int. Cl.[3] ..... E02D 27/00

[52] U.S. Cl. ..... 52/169.6; 52/20

[58] Field of Search ..... 52/169.1, 169.6, 169.7, 52/19, 20

[56] References Cited

U.S. PATENT DOCUMENTS

| | | | |
|---|---|---|---|
| 2,792,794 | 5/1957 | Miller | 52/20 |
| 2,830,675 | 4/1958 | Drager | 52/169.6 X |
| 3,138,124 | 6/1964 | Baier | 52/169.6 X |
| 3,164,111 | 1/1965 | Lanni | 52/20 |
| 3,173,387 | 3/1965 | Cree, Jr. | 52/20 |
| 3,196,813 | 7/1965 | McHugh, Jr. | 52/169.6 X |
| 3,212,220 | 10/1965 | Boniecki et al. | 52/169.6 X |

FOREIGN PATENT DOCUMENTS

| | | | |
|---|---|---|---|
| 892511 | 10/1953 | Fed. Rep. of Germany | 52/169.6 |
| 1074852 | 2/1960 | Fed. Rep. of Germany | 52/169.6 |
| 1264737 | 3/1968 | Fed. Rep. of Germany | 52/169.6 |
| 2499136 | 8/1982 | France | 52/169.6 |
| 350577 | 1/1961 | Switzerland | 52/169.6 |
| 2075570A | 11/1981 | United Kingdom | 52/169.6 |
| 2092633A | 8/1982 | United Kingdom | 52/169.6 |

*Primary Examiner*—Carl D. Friedman

*Attorney, Agent, or Firm*—Steele, Gould & Fried

[57] ABSTRACT

An underground protective shelter installation has several protective cells connected to one another, the cells being assembled of prefinished steel-reinforced concrete components which are hermetically sealed to one another and braced by clamping components. At least one opening is provided in a protective chamber for access to an inner chamber of the protective shelter installation. The protective chambers essentially comprise two basic prefinished components, namely a substantially circular disk used as an upper cover, intermediate ceiling, or as a lower closure, and a cylindrical ring, one story high and located between two of the disks. The entrance level includes an inner passageway and an outer entrance passageway having an exit opening above the protective shelter installation in the outdoor area.

12 Claims, 12 Drawing Figures

FIG. 6a
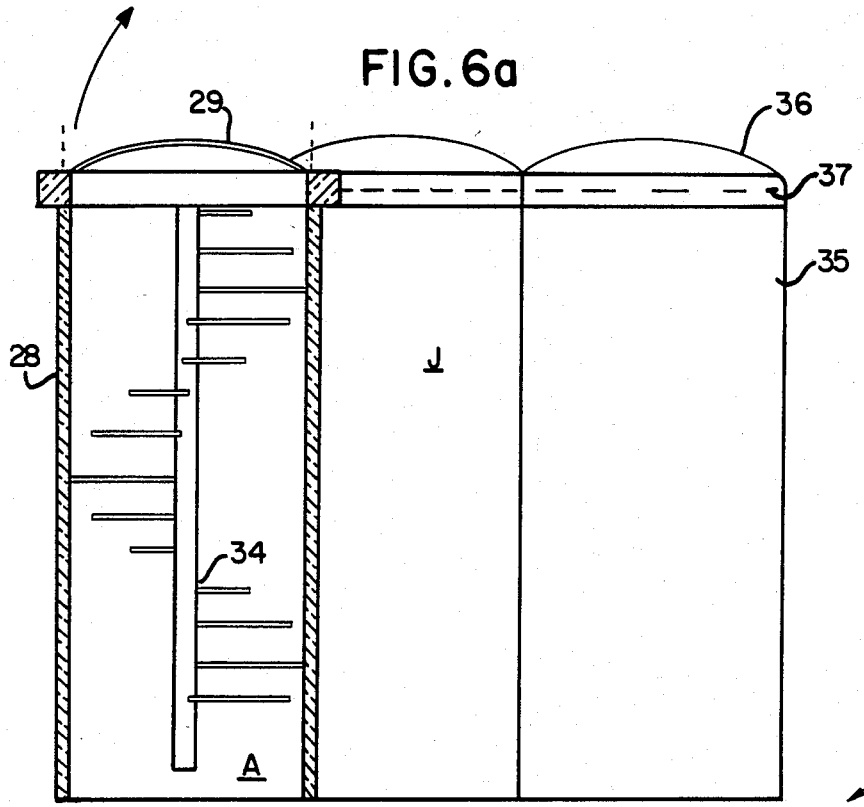
FIG. 6b
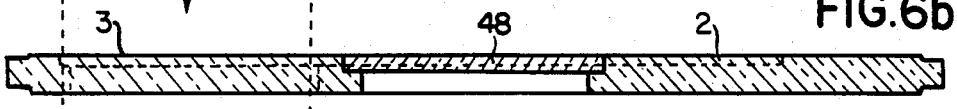
FIG. 6c
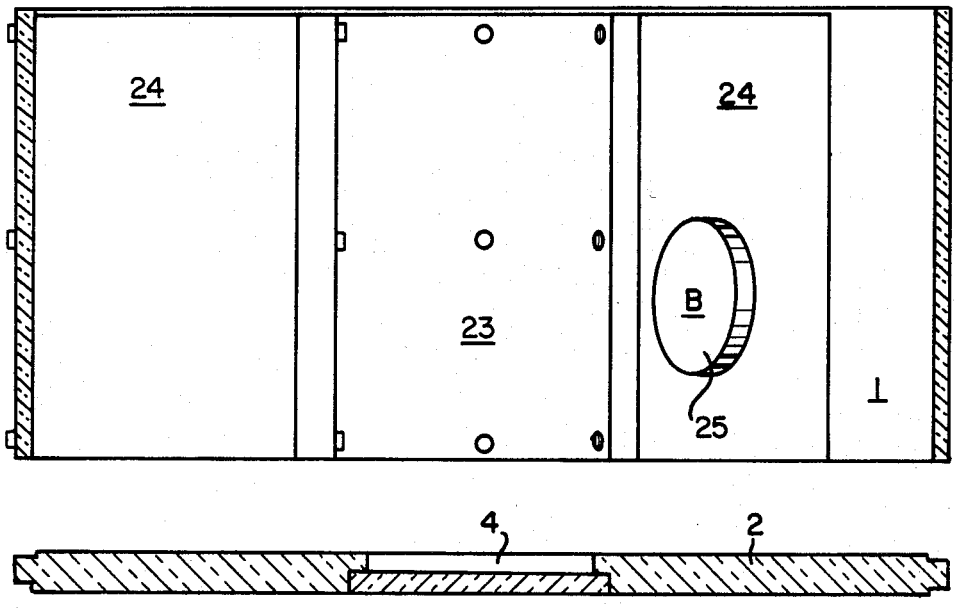
FIG. 6d

UNDERGROUND SHELTER

BACKGROUND OF THE INVENTION

1. Field of the Invention

The invention concerns an underground protective shelter, and in particular a shelter with a plurality of connected protective chambers, assembled of prefinished building components of steel-reinforced concrete, hermetically sealed at junctions, and braced by clamping components.

2. Description of the Prior Art

A protective bunker installation is disclosed in Offenlegungsschrift No. 21 60 570 having individual protective chambers in the shape of parabaloids, spheres, or other shapes which may be described by rotating curves. The chambers are connected to one another on their narrow, continuously-curved side surfaces by means of longitudinal, tubular-shaped connector tunnels. Each individual protective chamber is assembled of several prefinished and preferably sector-shaped steel-reinforced concrete components. Connection takes place along horizontal or vertical expansion joints and is intended to be humidity- and gas-tight.

Auslegesschrift No. 12 64 737 teaches an underground protective shelter installation having an entry passageway and access to a neighboring building. It additionally discloses an emergency exit, and has a passageway that and makes it possible to exit to open areas above ground.

Auslegesschrift No. 12 62 006 discloses an underground protective shelter installation of prefinished concrete components. The individual prefinished concrete components are connected with screws and suitable shearing inserts so that they are safeguarded against shearing and are gas- and moisture-tight.

Finally, Auslegesschrift No. 11 43 627 concerns an underground protective bunker installation of prefinished cement components with several connected protective chambers, wherein all the protective chambers are hollow spheres, the spheres being connected with one another by an intersecting seal across two opposite round openings of the same size.

Before the development and testing of the atomic bomb, conventional protective shelter installations consisted typically of very thick ceilings of steel and concrete, which were intended to mainly protect against the effect of explosions due to conventional bombs or artillery shells.

Such protective shelters were designed for protection against more or less direct hits and also for protection against the shrapnel and parts flying through the air in the vicinity of a bomb explosion. Protection against gas attack was primarily accomplished by individual protective equipment such as gas masks. The protective bunker installation in these times was used practically only during actual attack and could be safely left immediately after the attack.

Protective shelter installations formerly known and a few of the above mentioned ones, closely follow the construction principles valid at that time. For example, in Offenlegungsschrift No. 21 60 570, a heavy additional upper layer of cement is suggested, in order to protect against direct hits. The individual protective chambers of known protective shelter installations, however, are constructed most unappealingly and are suitable only for a short stay in the protective chamber itself. The design of known inner chambers give the visitor the impression that he is in protective custody. The chambers are strongly constructed, but are in no way comfortable or pleasing to the eye.

In modern times, civil defense protection against more or less direct hits from explosives projectiles has moved into the background compared to protection against atomic, bacteriological and chemical warfare. Today's protective bunker installations must be constructed to be sufficiently safe against these modern methods of warfare. In keeping with the nature of the expected lingering hazards, relatively long periods of stay in the bunker must be planned. These methods of warfare cause a much longer after-effect than former methods. The effects must be allowed to fade to levels nontoxic for humans before the shelter can be safely abandoned. For example, after the use of atomic weapons, a short period of initial radiation is expected, but thereafter residual radiation will remain, and fallout including radioactive rain.

After the use of bacteriological and chemical weapons, the environment may possibly be contaminated for an even longer period of time than that caused by the use of atomic warfare. The effects of such weapons force a minimum protective stay of several weeks, and preferably a longer period of stay in the protective bunker. Therefore the bunker must afford sufficient comfort and be designed for sufficient safety so that such long periods of time can be endured. Furthermore a protective bunker installation must satisfy the needs of the protected occupants insofar as possible and to afford them the capability of observing and exploring the immediate surroundings during the period the atomic, bacteriological, or chemical stress.

SUMMARY OF THE INVENTION

It is an object of the invention to avoid the disadvantages of known underground protective bunker installations, and to produce a shelter against modern forms of attack.

It is also an object of the invention to make such shelters suitable for extended periods of use.

It is another object of the invention to safely facilitate sampling and measuring of the contaminated environment in the area of the shelter.

It is yet another object of the invention to produce an optimum shelter which can be adequately constructed in a moderate price range.

These objects can be accomplished by starting with a protective shelter of a type in which the protective chambers consist essentially only of two types of differing prefinished parts. The two types are a nearly circular disk for an upper covering, an intermediate floor/ceiling or lower covering, and a one-story high cylindrical ring located between two such disks and forming exterior walls. The entrance of the protective bunker has a main passageway and an entry passageway with an exit that opens above the protective shelter in an open area outside the shelter.

The protective shelter installation and its essential building components are a series of simple elements, namely cylinders and disks. Assembly is therefore very simple. Several individual chambers can be stacked on top of one another like a house with several stories, because an additional level requires only a cylinder and a disk. It is also possible, due to the specific shapes employed, to closely connect individual chambers on the same plane, whereby large diameter and very short length connections are easily formed. Such connections enable comfortable traffic between individual protective chambers on the same plane without crawling through tube-like passages. The result is a number of comfortable and accommodating inner rooms of the protective installation. The floor of each individual chamber is flat and level and therefore easy to walk over in any direction. The inner chambers are likewise easily subdivided into living quarters, sectors, or such. Connecting stairs between protective chambers located above one another enable comfortable traffic between the protective chambers and at the same time provide welcome exercise for the body, during long confinement in the shelter.

An essential advantage of this invention can be seen in the double-lock passageway, which opens as an entrance passageway immediately above the protective shelter installation in the outdoor area. A decontaminated exit is made possible because of the two air lock chambers of the passageway. The passageway arrangement also enables users to leave and re-enter the protective chamber during times of sufficiently low danger, for the purpose of observing the condition of the outer area and making measurements. The outer environment can be thereby directly or indirectly accessed without incurring contamination of the inner areas or permanent damage. Unlike installations known to date, the decontaminated exit to the outdoor areas above the protective bunker is in effect a reversal of present entry and exit principles. The exit to the outdoor area as it has been known, for example in Auslegesschrift No. 12, 64 737, was intended and functional solely as an emergency exit. In contrast, the invention teaches use of such an exit as the main-exit. It can be used as such at any time for measurement, observation and surveillance tasks, especially during an instance requiring its protection from toxic conditions prevalent outside.

A special advantage of the protective shelter installation of this invention is its relatively low cost. The prefinished concrete elements can be constructed of much thinner material than those known in the art, because the danger of a direct hit from a regular concussive explosive weapon is relatively low. On the other hand, in the event of a direct hit with an atomic weapon, even a much greater concrete thickness than that used in known protective bunkers will not save the occupant. As protection against radiation a 3 meter thick layer of dirt is provided (i.e., approximately ten times the radiation-stopping value of the concrete), whereby almost 100% radiation protection is obtained. The simply shaped building components are relatively problem free with respect to manufacture and assembly, which again reduces the total expense. Finally the building method of multiple stacked stories clearly contributes to the cost reduction.

In summary, the invention makes possible the manufacture of an underground protective shelter installation of sufficient comfort and living space even for a stay of several months, provides effective and long-lasting protection, and can be produced at a relatively moderate price.

The disk and cylinder ring units are preferably formed with prepunched hole areas where required. The prefinished parts are thereby complete as manufactured. Alternatively, the areas intended for passages can be separated from the units along thinned, weakened lines, or the openings can be closed by separate disks at optional areas, which can be removed as desired during assembly.

In order to build any of a number of differing layouts of protective chambers in various combinations, only two of the same main building components are required. Only the numbers of units and unit positions need be varied.

The shape of the outer surface of the cylinder ring in the area surrounding each passageway hole includes a flat attachment surface. This enables the direct connection of another protective chamber, also having such an outer surface, whereby the connector need only be as long as double the wall thickness of the cylinder ring. The connector is thereby short and passage through the connector is easy and comfortable. The abutting surfaces furthermore enable a very stable connection of two protective chambers located on the same plane. The connection of individual protective cells in the shape of story-like cells placed on top of one another is basically more sturdy. However, because the stacked protective chambers form a unit, they cannot shear off from one another even during heavy earth movements. The risk of shearing can never be completely precluded for attached protective chambers located on one plane, even though the connectors are short.

Of great structural advantage is one or more interior wall members, the wall bearing vertical (i.e., axial) forces and extending radially, preferably from a point near the cylinder axis. A preferred wall forms a cylinder diameter and extends between upper and lower disks. Such centrally located bracing members make a far more sturdy structure possible by integrating the self-resilience of the components to be braced with one another, forming a single body.

It is of great advantage to design the exit as a cylindrical exit pipe and to locate a newelled spiral (circular) staircase therein, whereby the steps of the staircase may be manufactured of radiation-obstructing material, for example by adding lead. At the customary exit which ends outdoors, such an emergency exit absorbs radioactive radiation and thereby protects the inside of the protective chamber. Moreover, the staircase can be made slidable axially. In this manner the radiation obstructing capabilities can be positioned adjacent the entryway or slided back into regular operative position.

In the prior art, the substantial and cumulative leakage of radiation at the exit passageway tends to practically nullify very extensive protective measures against radioactive radiation taken in other areas. The design of the exit pipe of this invention, however, makes an effective shield against radioactive radiation possible. This shielding keeps the exit area free of radiation as compared with the outside area located next to the exit pipe. Instead of eventually exiting through an entryway filter chamber which has become completely-contaminated due to constant radiation, users exit through a passage shielded and sealed against radiation or contamination and still clean.

In order to be able to measure and observe, radiation-resistant measures are taken at the top of the exit pipe by providing an outside observation optical system. To prevent against short-term heat radiation damage a heat radiation shield is suitable and preferred.

It is advantageous to provide a decontamination chamber in the main passageway. In this manner it is possible to make the first tests and to conduct maintenance or repair work in the still heavily contaminated area above the protective chamber, if needed. Accordingly, the installation of this invention allows a safe, slow transition from the protected areas into the non-protected areas, without a possible lapse which could routinely defeat all previously performed protection endeavors.

It is also advantageous to construct the air filter with two stages and to locate at least one stage (e.g., the second stage) within the more-radioactive main passageway. Due to the decontamination capability, the filter can be safely cleaned or exchanged there without endangering the inhabitants of the radiation-free protective cell.

The first stage is preferably located outside the protective cell in a pipe, the shape of which corresponds to the exit pipe. The additional prefinished part is merely another standard tubular-type building component, although smaller than the main building components.

It is very advantageous to include an oxygen or compressed air container having the relatively large capacity of at least one daily supply of oxygen as required for a nominal number of occupants. It is said that after an atomic explosion, because of the subsequent widespread burning, the oxygen content of the ambient air is drastically lowered. Because of these storage measures, namely including an initial supply of oxygen, the air filters are conserved during the initial highest contamination period, and are not under stress. The filters therefore can be used longer and are less contaminated. Moreover, adequate oxygen is initially available regardless of a temporary reduction in ambient oxygen.

Further options and advantages of this invention are set forth in the appended claims, as well as the following description of the optimum and presently preferred form of construction of a shelter installation according to the invention.

BRIEF DESCRIPTION OF THE DRAWINGS

There are shown in the drawings the embodiments which are presently preferred. It should be understood, however, that the invention is not limited to the precise arrangements and instrumentalities shown.

FIGS. *6a–6d* constitute an assembly drawing showing a sectional view of a protective cell with exit pipe and air filter.

Figure 7:
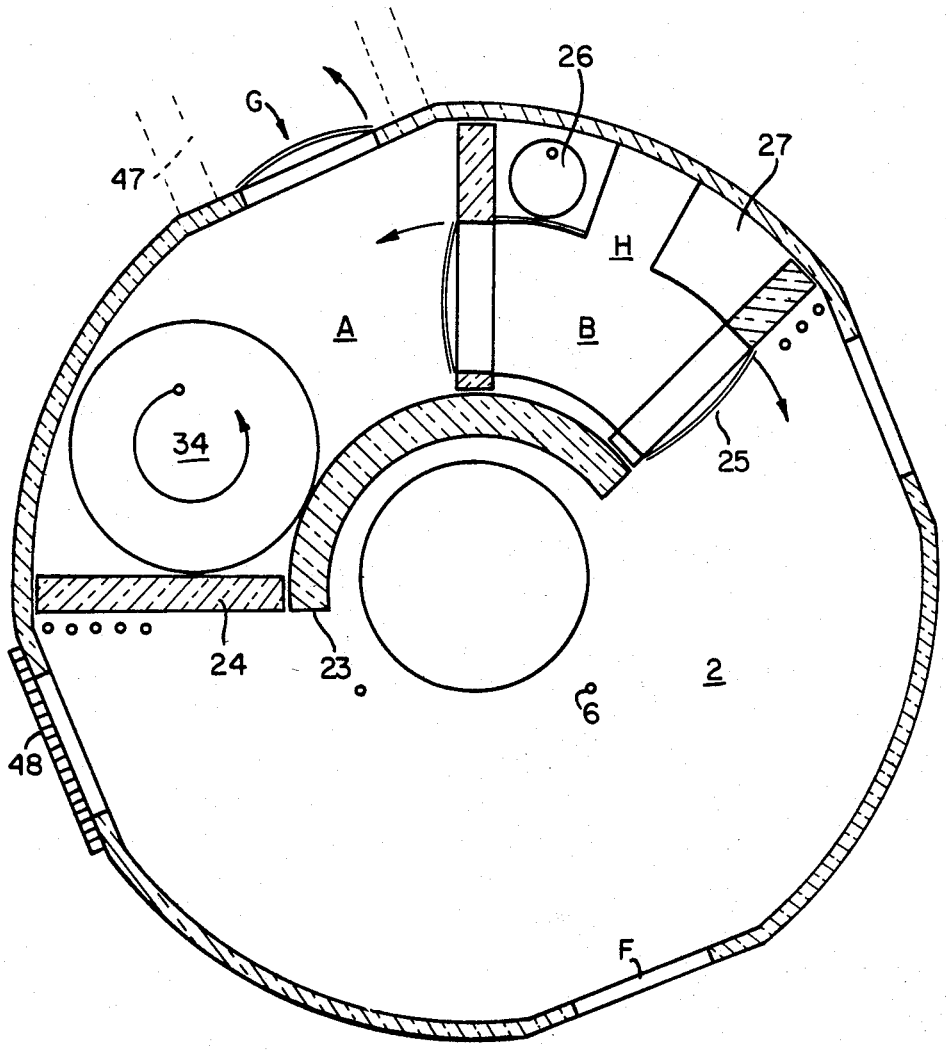

FIG. 7 is a sectional plan view along the axis of an entry cell.

Figure 8:
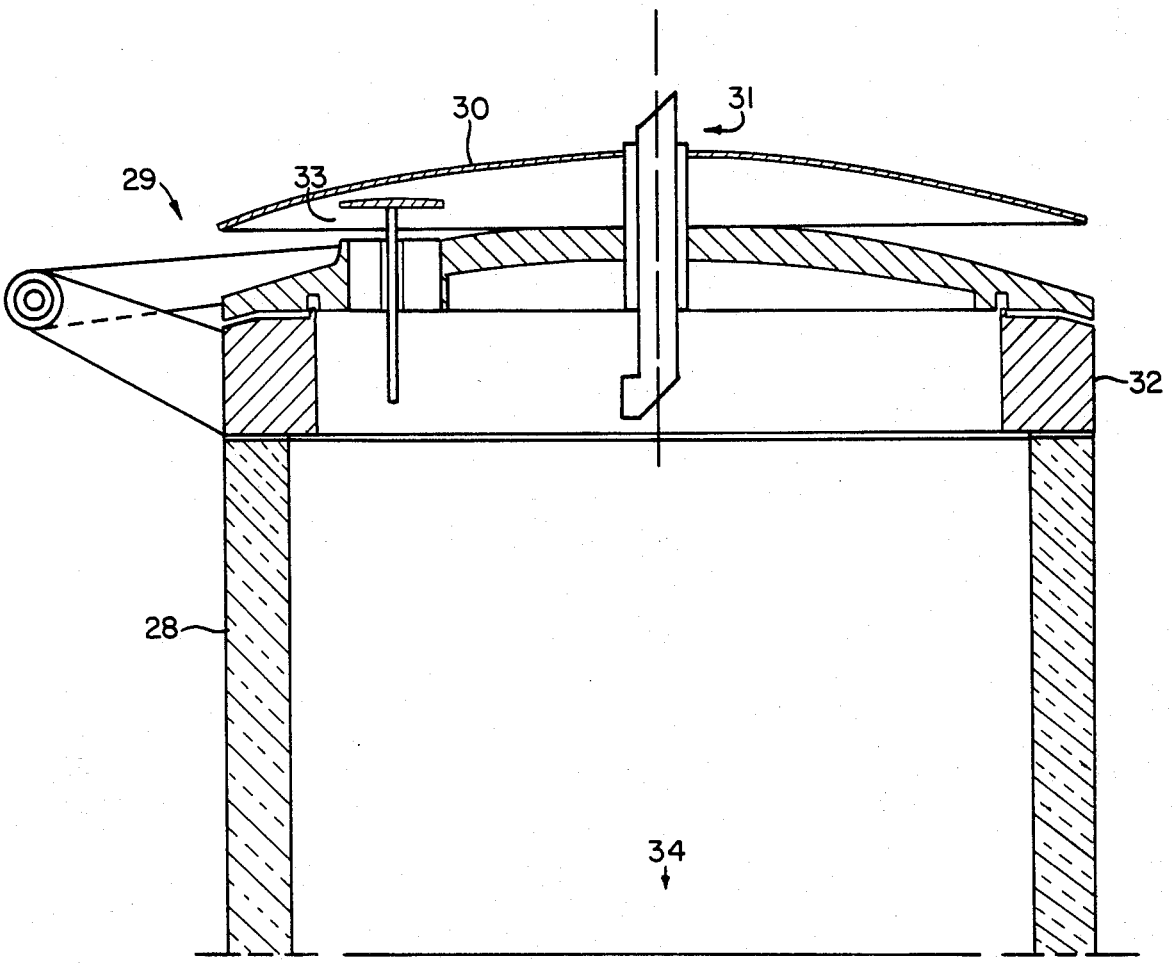

FIG. 8 is an side section view through the upper end of an exit pipe.

Figure 9:
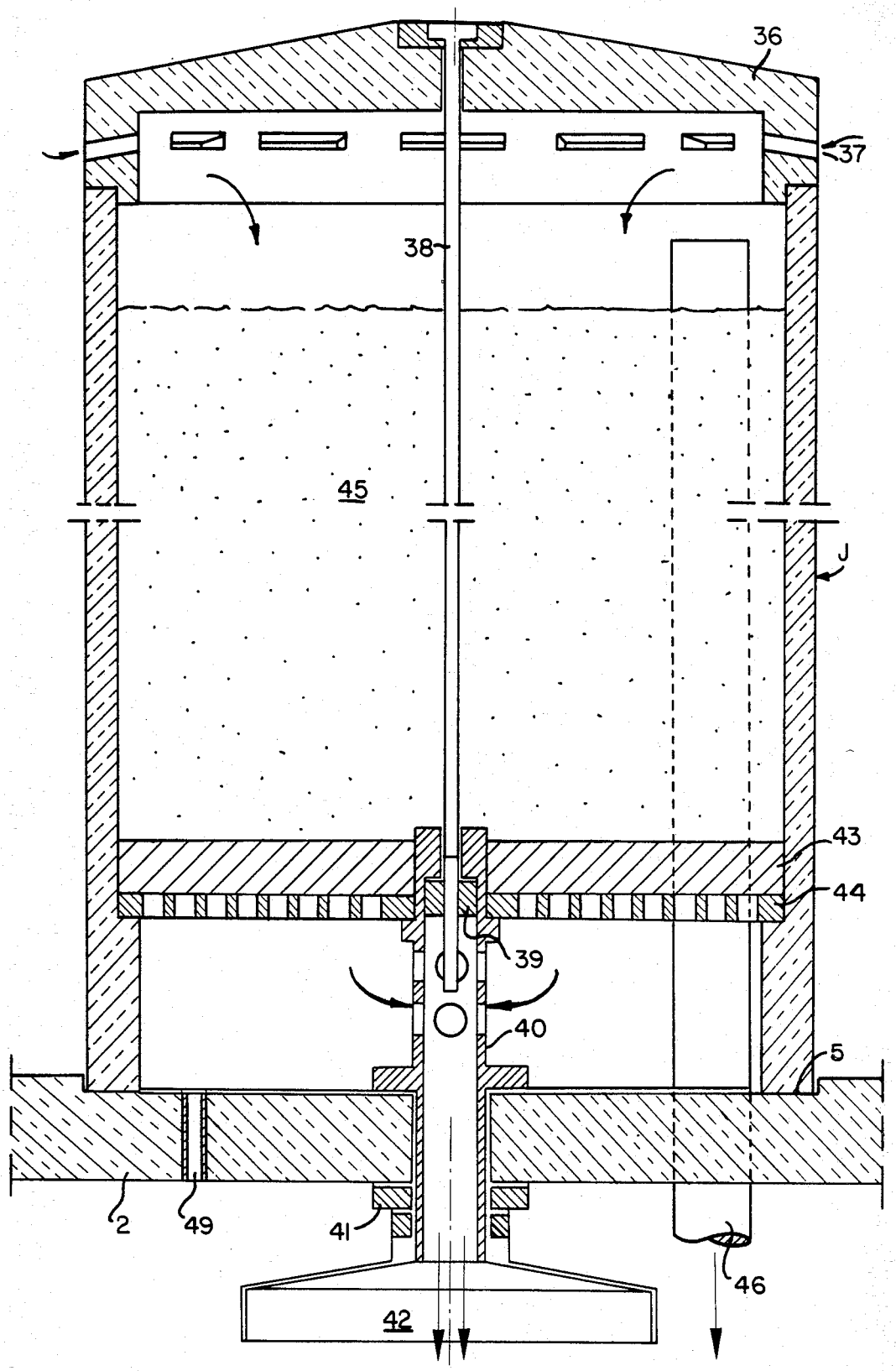

FIG. 9 is an side section view through the first stage of a filter.

DETAILED DESCRIPTION OF THE PREFERRED EMBODIMENTS

Figure 1:
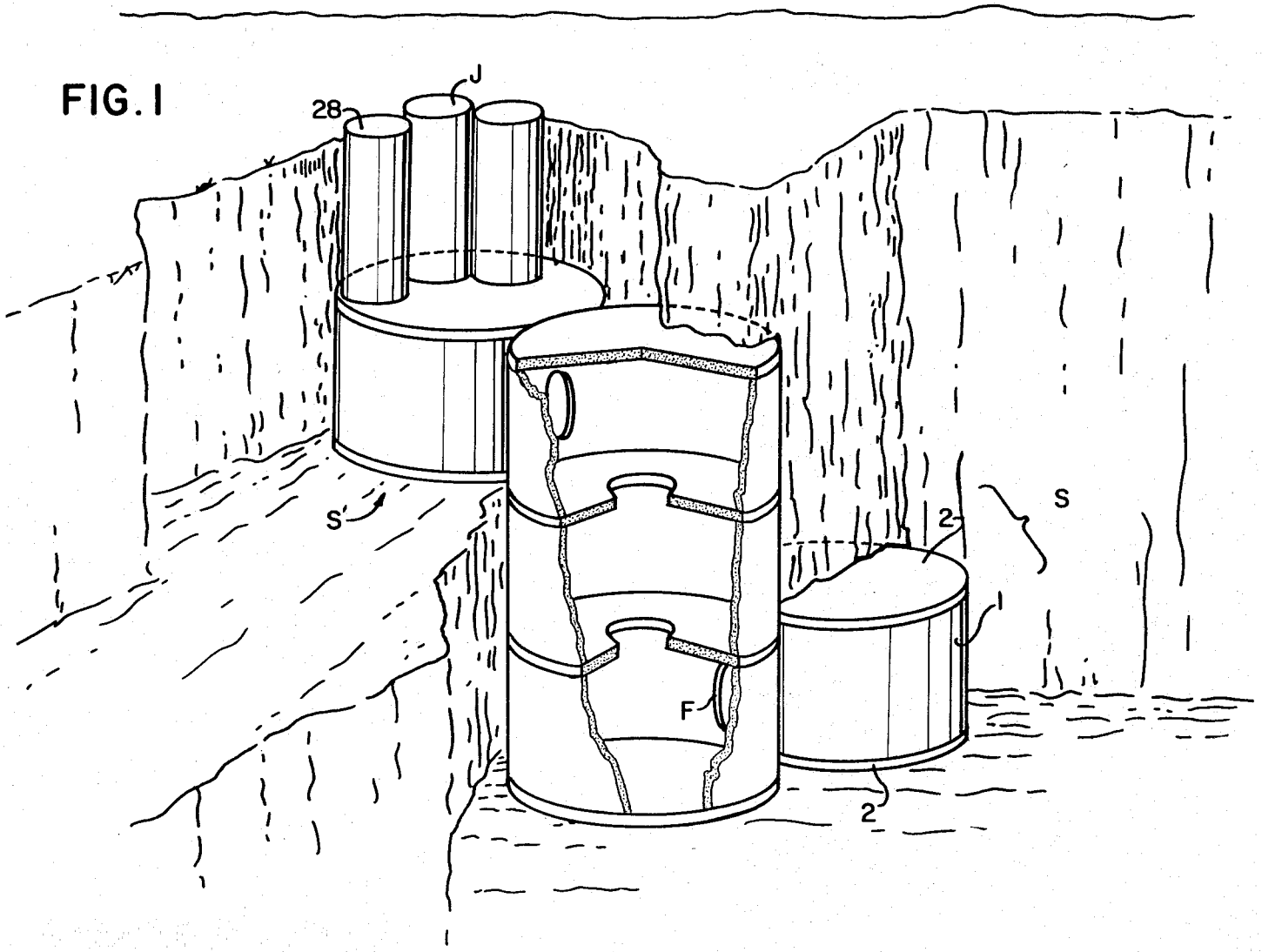
FIG. 1 is a perspective drawing of a protective bunker installation with an entry cell, a 3-story tower consisting of protective cells and a very deeply placed protective cell.

As FIG. 1 illustrates, the protective bunker installation is primarily constructed only of two types of large, prefinished building components, namely cylinder rings 1 and disks 2, forming cells. For an individual protective cell, for example the entry cell S', which is located at the upper left, two disks 2 and one cylinder 1 and required. The protective chambers can be connected to one another easily and at random in the horizontal plane, as well as the vertical plane, thereby forming either a modular system or a building block system. This satisfies the diverse demands of the individual builder as much as possible.

In FIG. 1 the protective chamber S is deeply buried, as shown on the lower right. The layer of earth above it is especially heavy. Protective chamber S is therefore an especially safe cell, where it is advisable to stay during and/or at least immediately after an atomic attack.

Figure 3:
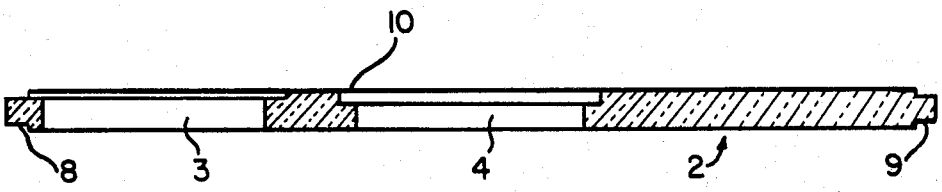
FIG. 3 is a sectional side view along the line III—III in FIG. 2.
Figure 2:
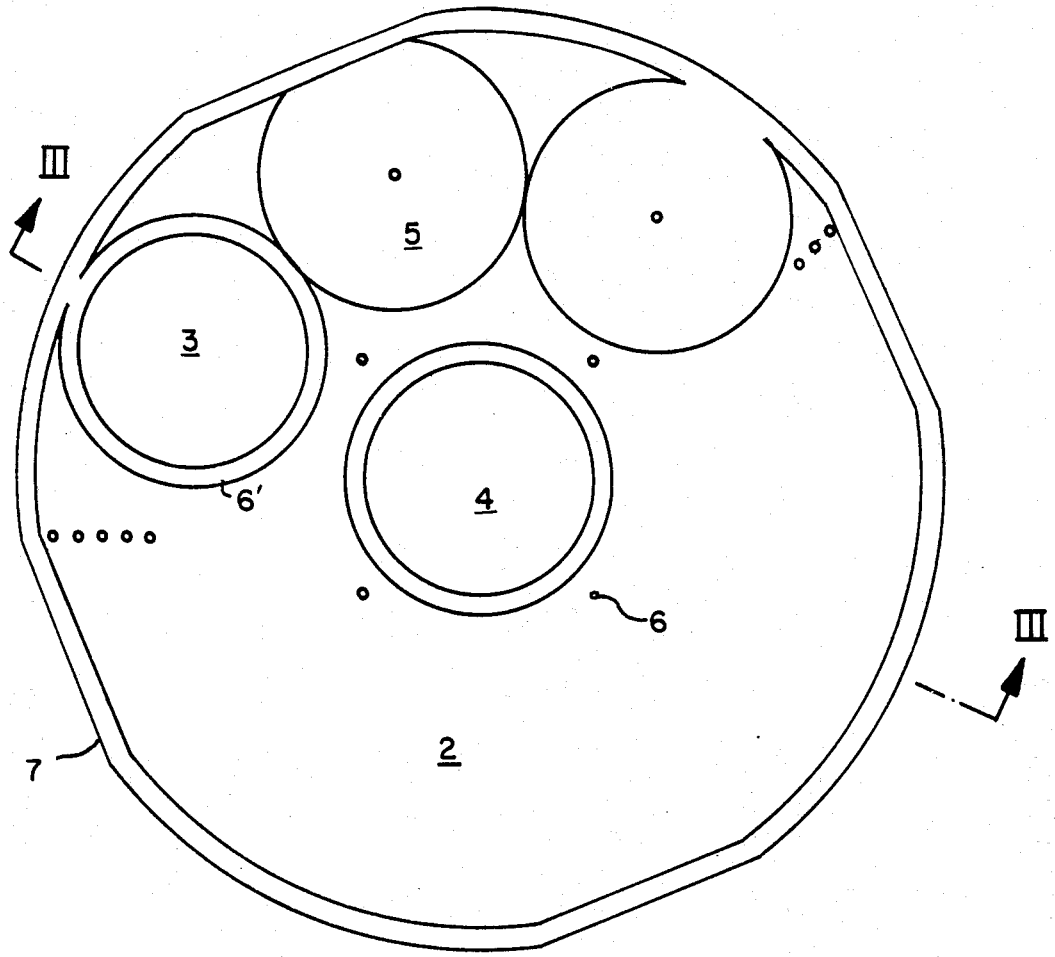
FIG. 2 is a top plan view of a disk.

The construction of disk 2 is illustrated in FIGS. 2 and 3. As shown, disk 2 has two prepunched hole areas 3, 4 and two prepared bases 5 for one pipe each of the first stage of an air filter. Finally, fastening points 6 are provided for clamping equipment to join the elements over gaskets. The hole area 3 is located on the edge of the disk and can be used to hold an exit pipe. Suitable fastening points 6 are provided, for example in a circle, for this purpose. The central penetrable hole area 4 can be used as the vertical passageway between two protective cells S. Of course, the penetrable hole area 3 can also be used to connect cells vertically, if desired.

The disk 2 is not perfectly circular. It has four evenly distributed flattened edge sections. The penetrable prepunched hole area 3 is displaced from nearby flat areas by a 45° angle. It is therefore possible to displace the hole areas 3 of successively stacked disks 2, located above one another, by 90° or 180°. This improves the protective shield and makes it possible to individually divide the inner chambers as the vertical passageway need not run for the entire length of the stacked chambers.

Figure 4:
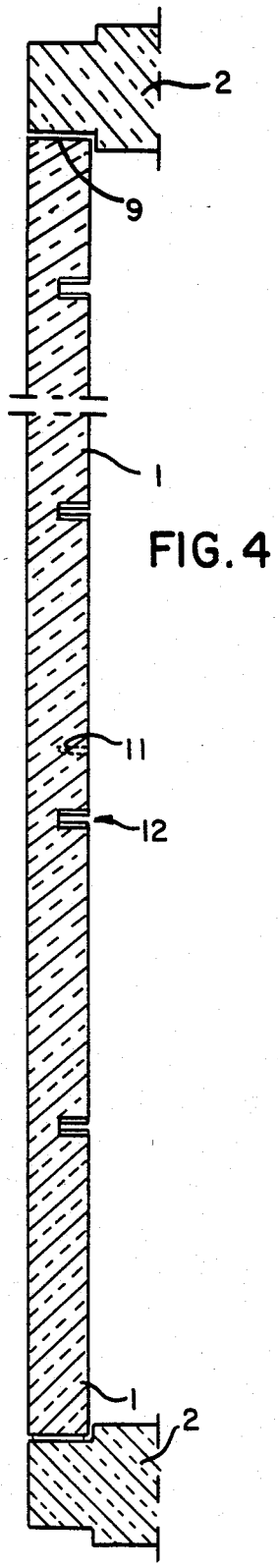
FIG. 4 is a section view through an outer wall of a protective cell.
Figure 5:
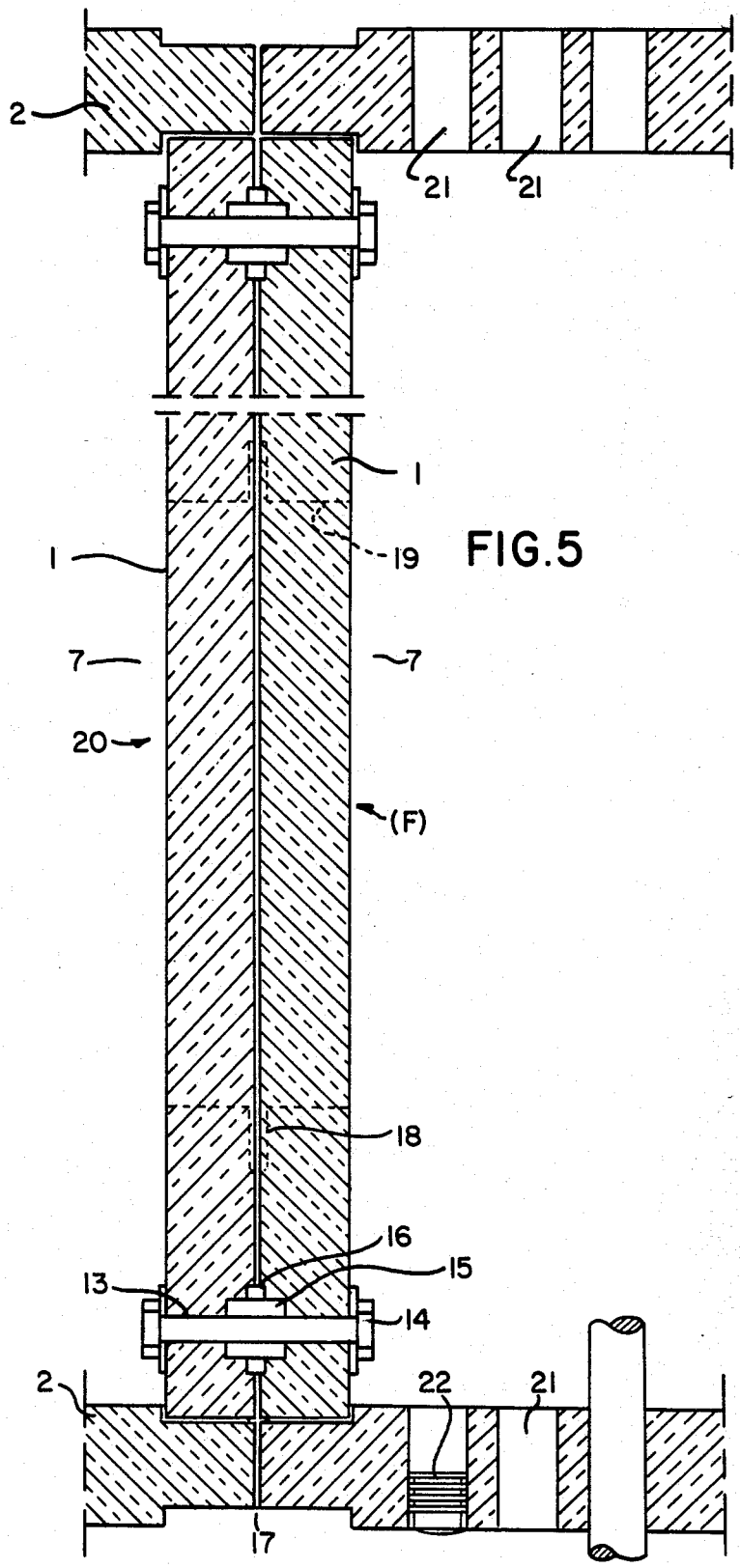
FIG. 5 is a vertical section through the connector area of two protective cells connected on the same plane.

FIG. 3 shows that the disk 2 has a recess 8 around its edge. The recessed edge allows disk 2 to separate cylinders 1 and forms an interconnection between cylinders and disks, and thereby between stacked cylinders, which resists horizontal shearing stress. In the recesses 8, gaskets 9 are mounted, as can be seen in FIGS. 4 and 5. Gaskets 9 are positioned by recess 8 and cannot be mounted in incorrect locations. The penetrable hole areas 3 and 4 also have surrounding depressions 10, as is illustrated in FIG. 3, which guarantee a safe and secure connection to pipe members, as well as correct placement of a premounted gasket.

The assembly of two disks 2 and a cylinder ring 1 for a protective chamber S can be seen in FIG. 4, which also illustrates the relatively small material thickness of the prefinished concrete parts 1, 2. The inner wall of the cylinder ring 1 contains an empty pipe 11 for making electrical connections. The connections can be sealed off after installation. Dowels 12, or similar means for making mechanical connections, are provided in the cylinder wall and are used to mount technical equipment, internal separating walls and the like.

FIG. 5 illustrates the connection of two protective cells S on the same plane. The cylinder ring 1 and the disks 2 of the neighboring protective cells S touch in the flattened areas 7, which are provided in the edges of disks 2 and in the sides of cylinder rings 1. Thus there are relatively large mating connecting areas between the neighboring protective cells S and the passages for horizontal traffic through openings F are relatively large, of short length, and comfortable. The neighboring cylinder rings 1 are held to one another over high strength necked-down bolts 13 and nuts 14. In their centers adjacent the abutted faces of attached cylinders, the bolts 13 are reinforced by shearing casings 15; the shearing casings 15 are in turn surrounded by gaskets 16. To seal against penetrating gas, round gaskets 18 can be inserted between abutting cylinders to surround passage opening F. In FIG. 5 the passage opening F has not yet been opened. Only weakened lines 19 are shown, which define one of a total of four penetrable hole areas 20 of the cylinder ring 1, which may be used as needed. Finally FIG. 5 shows installation passages 21 of a disk 2, which are small openings normally closed by a stopper 22 and sealed off when they are not used, for example as conduits or as convenient attachment points during assembly.

FIGS. *6a–6d* and 7 show the construction of a preferred entry chamber. In the entry chamber S′ (also shown in FIG. 1) are an inner passageway section B with decontamination chamber H and a section of an outer entrance passageway A. The separation of these passageway chambers is accomplished by semicircular brace wall 23 and several radially positioned wall plates 24. Both of the plates which border the inner passageway section B are provided with a closeable door or cover 25. In the decontamination room H are a shower 26 and a closet 27 for ready storage of protective clothing.

Outer entrance passageway A is connected to the outside over a penetrable hole area 3 with an exit pipe 28. On the upper end of the pipe is a hatch 29 through which to enter and exit. Together with the regular door 25, hatch 29 defines both ends of the entrance passageway A.

Hatch 29 has a radiation heat shield 30, as is illustrated in FIG. 8. Furthermore, an observation prism 31 is provided. Located below the hatch 29 is a turntable 32 with welded bearings. Through a pressure valve 33, all the exhaust air of the system, namely that coming from the protective chamber S, and flowing through entrance passageways, is continuously pushed to the outside. This positive pressure makes expensive sealing measures in the range of the exit hatch 29 unnecessary and the results are that the exhaust is automatically removed from the individual passageways A, B, when they are used during an attack. In the exit 28 is a movable newelled circular staircase 34, which reaches to the floor of the entry chamber S. It makes possible a comfortable entrance to the hatch 29 and thereby a comfortable entry and exit, and forms the observation platform.

Next to the exit pipe 28 are two first stages of an air filter J, which are accommodated in two similarly shaped pipes 35 of dimensions like exit pipe 28. These pipes are placed on platform 5 of disk 2 above chamber S′. The construction of the air filter J is illustrated in FIG. 9. The filter is covered on top by a cover 36. The cover has radial inlet ports 37. With the aid of a turnscrew and an adjusting nut 39, the cover 36 is pulled against the platform 5 of the disk 2, by means of special pipe 40. Pipe 40 is bolted over by nut 41 below disk 2 and sealed. Pipe 40 also guides the mechanically prefiltered air in the first stage downward into a second stage 42 which has an active filter. The air path is shown by arrows. The first stage J is locked below by a screen and grate 44. In the space above, suitable filter material 45 is stored, for example sand. Finally a by-pass conduit 46 is provided, over which normal air can be drawn in if desired. Also included is a drainage opening 49. Possible residual radiation in air from the first filter stage J—quite reduced from outside air—is passed into the inner passageway B for further filtering, however, not directly into the protective chamber S itself.

The entrance passageway A has a third door G, which opens into an underground shaft 47, shown in FIG. 7. This door connects the protective bunker installation with a neighboring building and is mainly used during peaceful times. In the event of an attack the shaft is used exclusively as a refuse depository.

Finally, FIG. 7 illustrates additional opened, horizontal passage openings F, one of the passage openings F being sealed off by a disk 48.

The invention is capable of further variations which will now become apparent to persons skilled in the art. Reference should be made to the appended claims, rather than the foregoing specification, as indicating the true scope of the invention.

What is claimed is:

1. An underground protective shelter, comprising:

a plurality of connected protective cells hermetically sealed with one another and held together by clamping elements, each protective cell having an inner protective chamber and at least one opening for entrance to said inner chamber, the cells being formed from prefinished building components of steel-reinforced concrete and including a substantially circular disk forming at least one of an upper covering, an intermediate ceiling, and a lower closure, and a cylinder ring disposed against said disk;

one of the cells being an entrance cell and comprising an inner passageway connected to an outer entrance passageway, the inner passageway having an access to the inner protective chamber of the entrance cell and the outer entrance passageway having an access above the entrance cell in an above ground area, the connection of the passageways and the accesses being formed by hermetically sealable doors, the outer entrance passageway having a further door which opens to a below ground entrance tunnel;

a two stage air filter, a first stage of said filter being located outside the cells, and a second stage being located in the inner passageway and having a replaceable filter element; and, means for maintaining the protective shelter at an air pressure in excess of atmospheric pressure, including a pressure-openable exhaust valve vented to the outside, whereby exhaust air coming from the inner chambers of the cells and flowing through the inner passageway and the outer entrance passageway is continuously pushed to the outside.

2. The protective shelter of claim 1, wherein the disk and the cylinder ring are provided with prepared, prepunched hole areas for the passageways.

3. The protective shelter of claim 2, wherein the cylinder ring is flat on an external area thereof adjacent the hole areas, whereby adjacent prefinished components can be closely abutted.

4. The protective shelter of claim 1 further comprising at least one axial bracing wall located adjacent the cylinder axis.

5. The protective shelter of claim 1 wherein the disk and cylinder ring have complementary shapes interfitting at a recess.

6. The protective shelter of claim 5, further comprising a gasket mounted within the recess.

7. The protective shelter of claim 1 further comprising an exit pipe having an axially slidable circular staircase therein, the pipe located above the entrance and defining the access passageway, the staircase being manufactured of a radiation-retarding material.

8. The protective shelter of claim 7, further comprising a cover on the exit pipe having a radiation heat shield and an observation prism.

9. The protective shelter of claim 1, wherein the inner passageway contains a decontamination chamber having a shower and storage space for protective gear and decontamination agents.

10. The protective shelter of claim 1, wherein at least two selectable first filter stages are provided.

11. The protective shelter of claim 1, further comprising means for storing oxygen, the means having a storage capacity of at least one daily requirement for occupants of the protective shelter.

12. The protective shelter of claim 1, wherein the cylinder rings and the disks have a regular polygonal cross-section.

* * * * *